US009590360B2

(12) United States Patent
Chuang

(10) Patent No.: US 9,590,360 B2
(45) Date of Patent: Mar. 7, 2017

(54) ELECTRICAL CONNECTOR HAVING IMPROVED HOUSING AND METHOD OF MAKING THE SAME

(71) Applicant: FOXCONN INTERCONNECT TECHNOLOGY LIMITED, Grand Cayman (KY)

(72) Inventor: Shun-Jung Chuang, New Taipei (TW)

(73) Assignee: FOXCONN INTERCONNECT TECHNOLOGY LIMITED, Grand Cayman (KY)

( * ) Notice: Subject to any disclaimer, the term of this patent is extended or adjusted under 35 U.S.C. 154(b) by 0 days.

(21) Appl. No.: 14/833,153

(22) Filed: Aug. 24, 2015

(65) Prior Publication Data

US 2016/0056583 A1 Feb. 25, 2016

(30) Foreign Application Priority Data

Aug. 22, 2014 (TW) ..... 103129073 A

(51) Int. Cl.

| | |
|---|---|
| ***H01R 24/00*** | (2011.01) |
| ***H01R 13/6581*** | (2011.01) |
| ***H01R 12/57*** | (2011.01) |
| ***H01R 13/627*** | (2006.01) |
| ***H01R 43/24*** | (2006.01) |

(52) U.S. Cl.

CPC ..... *H01R 13/6581* (2013.01); *H01R 12/57* (2013.01); *H01R 13/627* (2013.01); *H01R 43/24* (2013.01)

(58) Field of Classification Search

CPC .... H01R 23/02; H01R 24/60; H01R 13/6275; H01R 13/6582; H01R 13/658; H01R 13/6585

USPC ..... 439/660, 941, 607.05, 607.55–607.58

See application file for complete search history.

(56) References Cited

U.S. PATENT DOCUMENTS

| | | | | |
|---|---|---|---|---|
| 6,409,543 | B1 | 6/2002 | Astbury et al. | |
| 7,097,506 | B2 | 8/2006 | Nakada | |
| 7,682,199 | B2 | 3/2010 | Ahn et al. | |
| 7,918,695 | B2 * | 4/2011 | Kutsuna | H01R 13/187 439/845 |
| 8,109,795 | B2 | 2/2012 | Lin et al. | |
| 8,262,411 | B2 | 9/2012 | Kondo | |
| 8,461,465 | B2 | 6/2013 | Golko et al. | |
| 8,684,769 | B2 * | 4/2014 | Kao | H01R 13/6471 439/607.28 |

(Continued)

FOREIGN PATENT DOCUMENTS

| | | |
|---|---|---|
| CN | 203193000 | 9/2013 |
| TW | 484822 | 8/2014 |

*Primary Examiner* — Abdullah Riyami
*Assistant Examiner* — Thang Nguyen
(74) *Attorney, Agent, or Firm* — Wei Te Chung; Ming Chieh Chang

(57) ABSTRACT

An electrical connector (100) includes a pair of modules (3) each including a row of terminals (31) and a first housing (32) insert molded with the terminals, a metal plate (1) sandwiched between the pair of modules, a pair of latches affixed to the metal plate, and a second housing over molded with the pair of modules, the metal plate, and the pair of latches to form a subassembly. Each terminal includes a securing portion (312) secured to the first housing, a soldering portion (313) extending rearwardly from the first housing, and a contacting beam (311) cantilevered forwardly from the first housing.

18 Claims, 7 Drawing Sheets

(56) References Cited

U.S. PATENT DOCUMENTS

| | | | | |
|---|---|---|---|---|
| 8,784,134 | B2 | 7/2014 | Wu et al. | |
| 8,794,981 | B1 | 8/2014 | Rodriguez et al. | |
| 8,968,031 | B2 * | 3/2015 | Simmel | H01R 13/659 439/108 |
| 9,022,800 | B2 * | 5/2015 | Yang | H01R 13/6581 439/487 |
| 2011/0151716 | A1 * | 6/2011 | Kondo | H01R 13/6658 439/607.01 |
| 2011/0230076 | A1 * | 9/2011 | Lim | H01R 9/032 439/345 |
| 2013/0117470 | A1 | 5/2013 | Terlizzi et al. | |
| 2013/0330976 | A1 | 12/2013 | Simmel et al. | |
| 2014/0194005 | A1 | 7/2014 | Little et al. | |
| 2014/0206209 | A1 * | 7/2014 | Kamei | H01R 24/60 439/81 |
| 2015/0364871 | A1 * | 12/2015 | Lin | H01R 13/6581 439/607.58 |
| 2016/0013592 | A1 * | 1/2016 | Kao | H01R 13/6471 439/607.55 |
| 2016/0013599 | A1 * | 1/2016 | Ueda | H01R 13/6596 439/607.01 |

* cited by examiner

ELECTRICAL CONNECTOR HAVING IMPROVED HOUSING AND METHOD OF MAKING THE SAME

BACKGROUND OF THE INVENTION

1. Field of the Invention

The present invention relates to an electrical connector, and more particularly to a USB (Universal Serial Bus) connector adapted for being normally and reversely mating with a mating connector and a method of making the same. The instant application relates to the copending application having the same applicant and the same assignee with the Ser. No. 14/825,122.

2. Description of Related Art

U.S. Pat. No. 8,684,769, issued on Apr. 1, 2014, discloses a socket connector and a mating plug connector. The socket connector includes an upper housing, a set of upper contacts arranged upon the upper housing, a lower housing, a set of lower contacts arranged upon the lower housing, and a shielding plate between the upper housing and the lower housing. The upper housing and the lower housing are then inserted into a bracket. The plug connector includes a housing having a pair of extending portions for fixing two rows of plug contacts and a shielding sheet between the two rows of plug contacts.

U.S. Patent Application Publication No. 2014/0194005, published on Jul. 10, 2014, discloses a receptacle connector including an upper terminal module, a lower terminal module, a metallic shielding/reinforcement plate located between the upper and lower terminal modules, and an insulative housing receiving the modules/plate combination.

A strengthened and easily manufactured USB connector is desired.

SUMMARY OF THE INVENTION

Accordingly, an object of the present invention is to provide an electrical connector having a solid construction and easy to manufacture.

In order to achieve the object set forth, an electrical connector includes a pair of modules each including a row of terminals and a first housing insert molded with the terminals, a metal plate sandwiched between the pair of modules, a pair of latches affixed to the metal plate, and a second housing over molded with the pair of modules, the metal plate, and the pair of latches to form a subassembly. Each terminal includes a securing portion secured to the first housing, a soldering portion extending rearwardly from the first housing, and a contacting beam cantilevered forwardly from the first housing.

A method of manufacturing an electrical connector includes the steps of insert molding a first housing and a row of terminals to form a module, forming a pair of said modules, sandwiching a metal plate between the pair of modules; and over molding a second housing with the pair of modules and the metal plate.

The second housing is over molded with the pair of modules and the metal plate to firmly fix the second housing and metal plate. The pair of latches are connected with the metal plate for latching with the mating receptacle and improving grounding effect.

Other objects, advantages and novel features of the invention will become more apparent from the following detailed description when taken in conjunction with the accompanying drawings.

DETAILED DESCRIPTION OF THE PREFERRED EMBODIMENT

Figure 1:
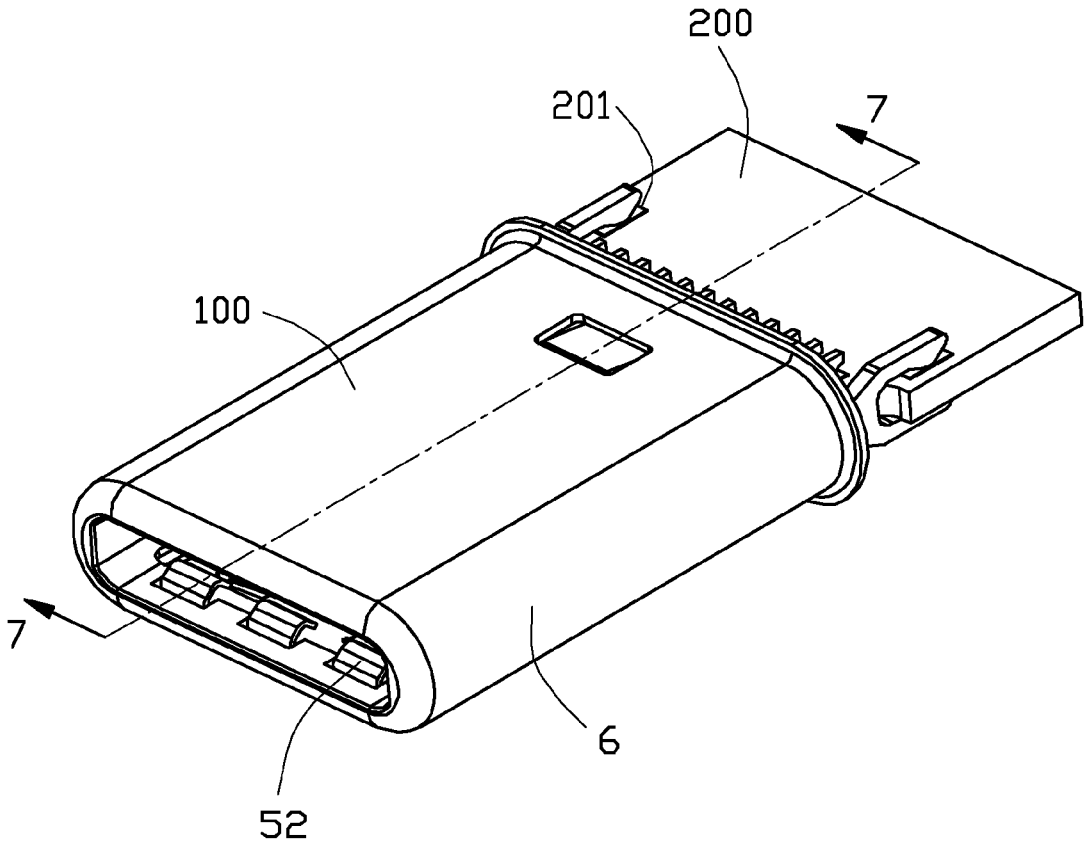
FIG. 1 is an assembled perspective view showing an electrical connector and a circuit board in accordance with the present invention.

Reference will now be made in detail to the preferred embodiment of the present invention. Referring to FIGS. 1-7, an electrical connector 100 refers to a plug connector adapted for being normally and reversely inserted in a mating receptacle. The electrical connector 100 comprises a pair of module 3, a metal plate 1, a pair of latches 4, a second housing or sub-housing 22, a third or main housing 23, a pair springs or spring plates 5, a pair of adhering portions 7 and a shielding shell or sleeve 6.

Figure 2:
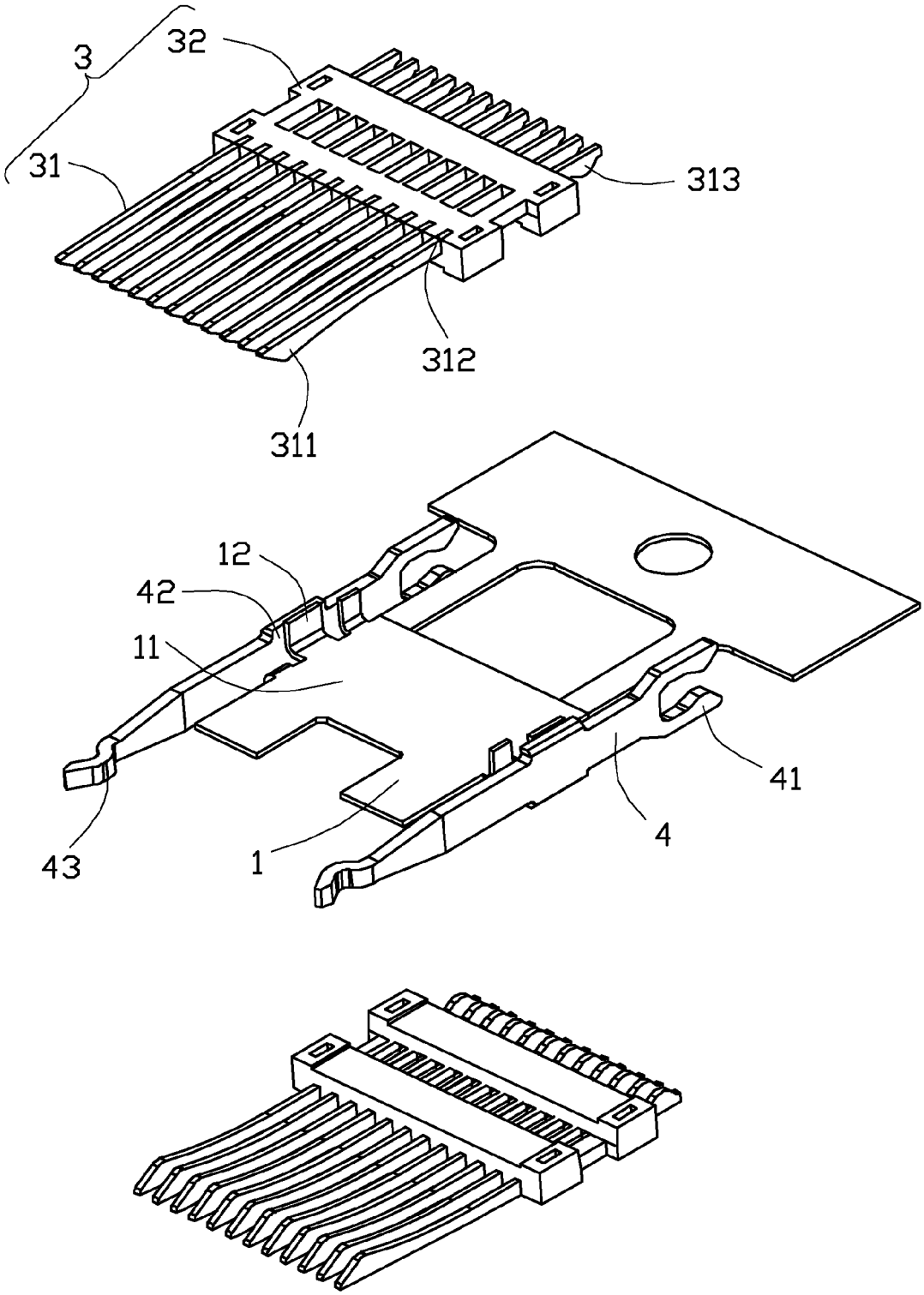
FIG. 2 is an exploded view showing a pair of modules, a metal plate and a pair of latches.
Figure 3:
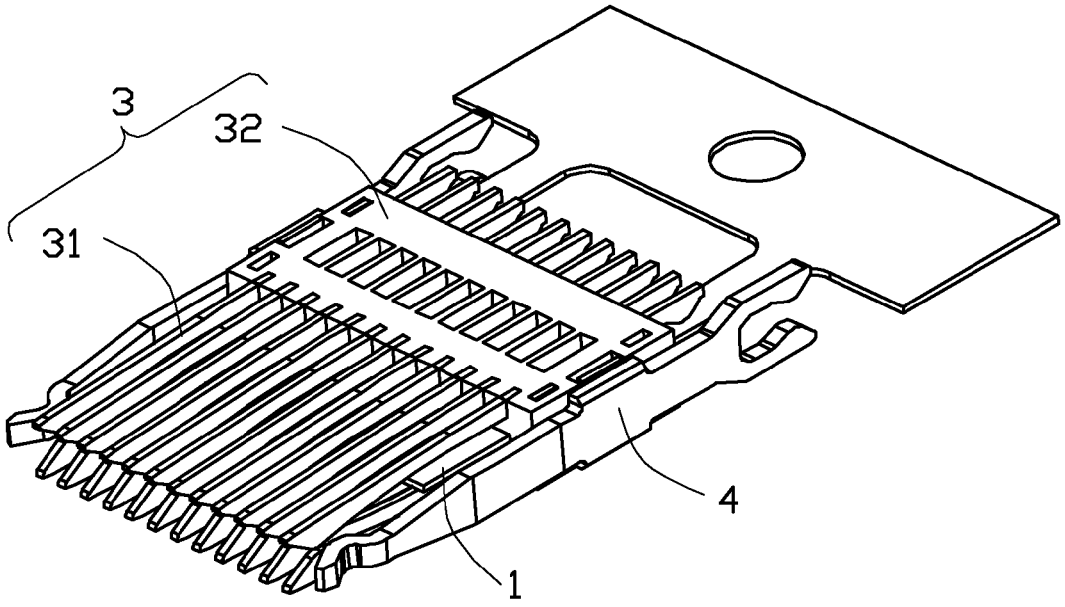
FIG. 3 is an assembled view of a pair of modules, a metal plate and a pair of latches shown in FIG. 2.
Figure 4:
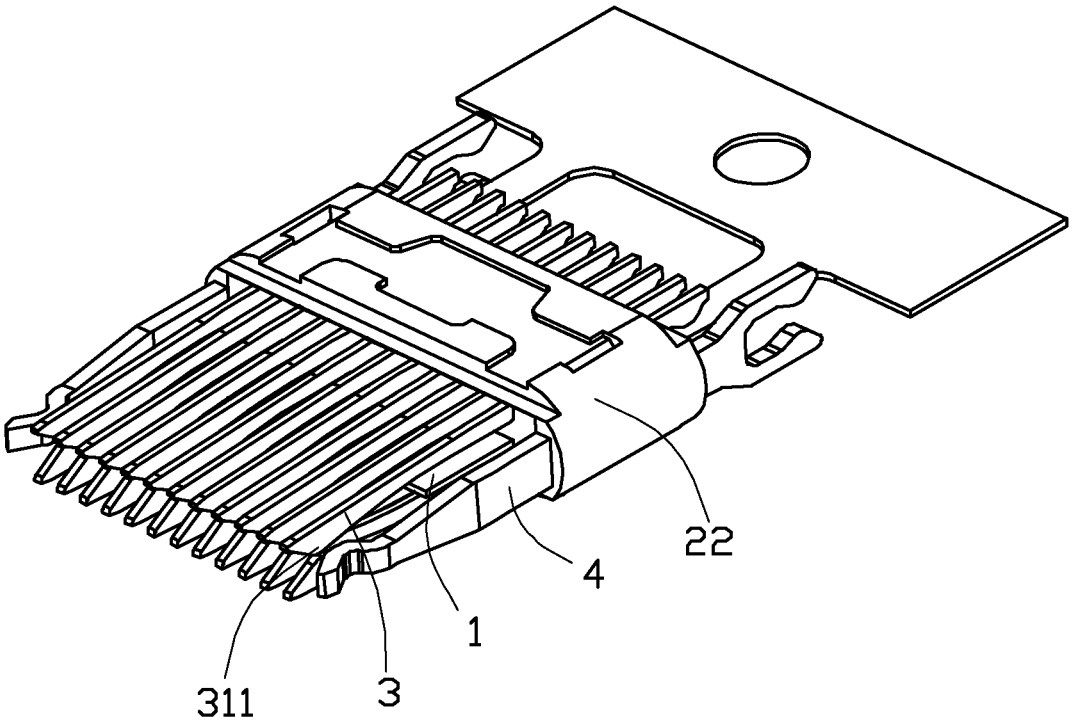
FIG. 4 is an assembled view of a pair of modules, a metal plate and a pair of latches, and a second housing.

Referring to FIG. 2, each module 3 includes a row of terminals 31 and a first housing or insulator 32 inset molded with the terminals 31. Each terminal 31 has a body portion 312 secured to the first housing 32, a resilient contacting beam 311 cantilevered forwardly from the first housing 32 and having a contacting portion/mating section (not labeled), and a soldering portion or connecting section 313 extending rearwardly.

The metal plate 1 includes a main portion 11, and a pair of affixed portions 12 formed at opposite sides of the main portion 11.

Each latch 4 includes a resilient latching portion or locking section 43 at a front, an engaging portion 42 formed at substantially a middle portion thereof, and a pair of soldering feet or rear connecting portions 41, projecting toward each other. The latching portion 43, the engaging portion 42 and the soldering feet 41 are sequentially formed along a front-to-back direction.

Figure 5:
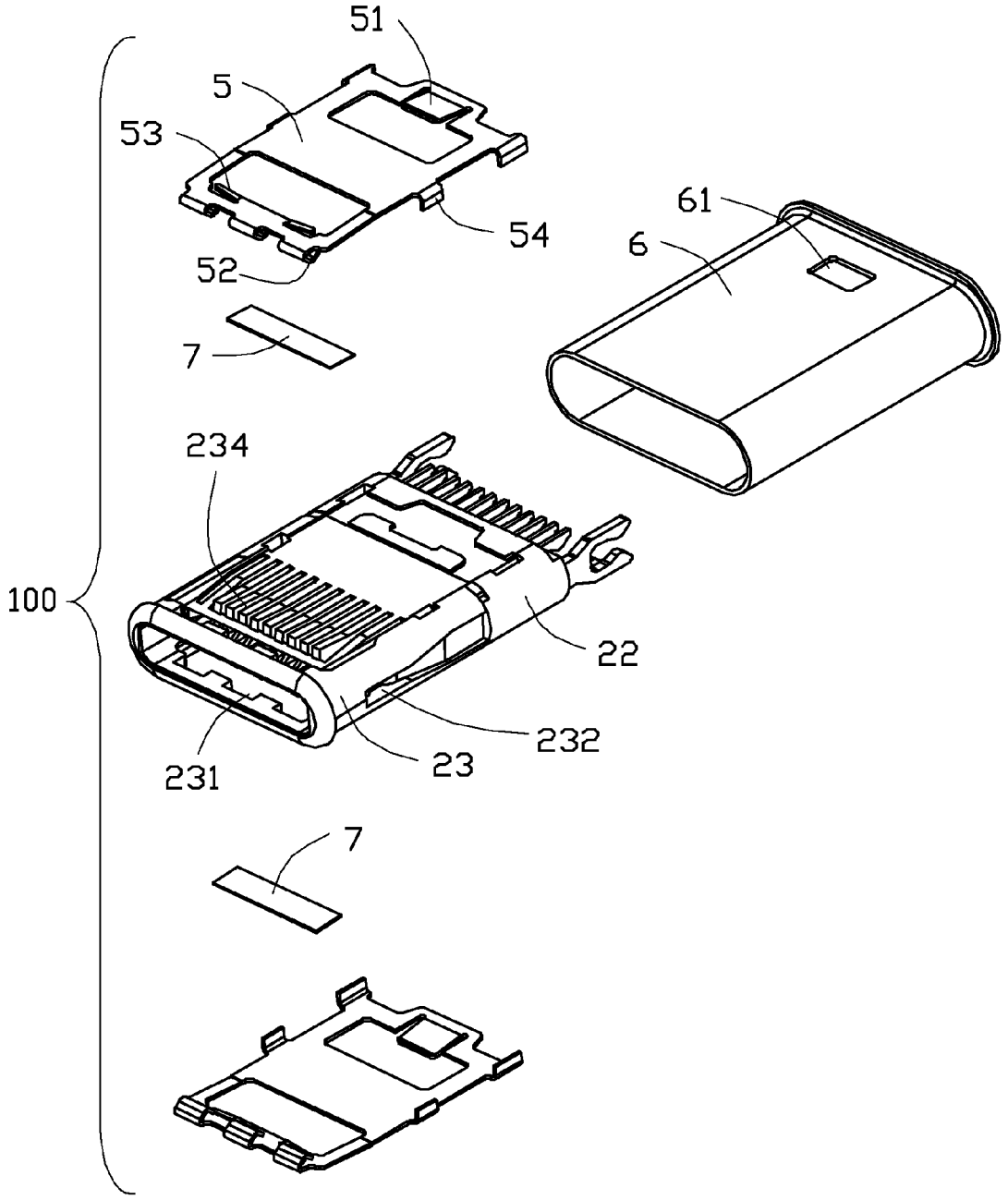
FIG. 5 is a exploded view showing the electrical connector shown in FIG. 1.
Figure 6:
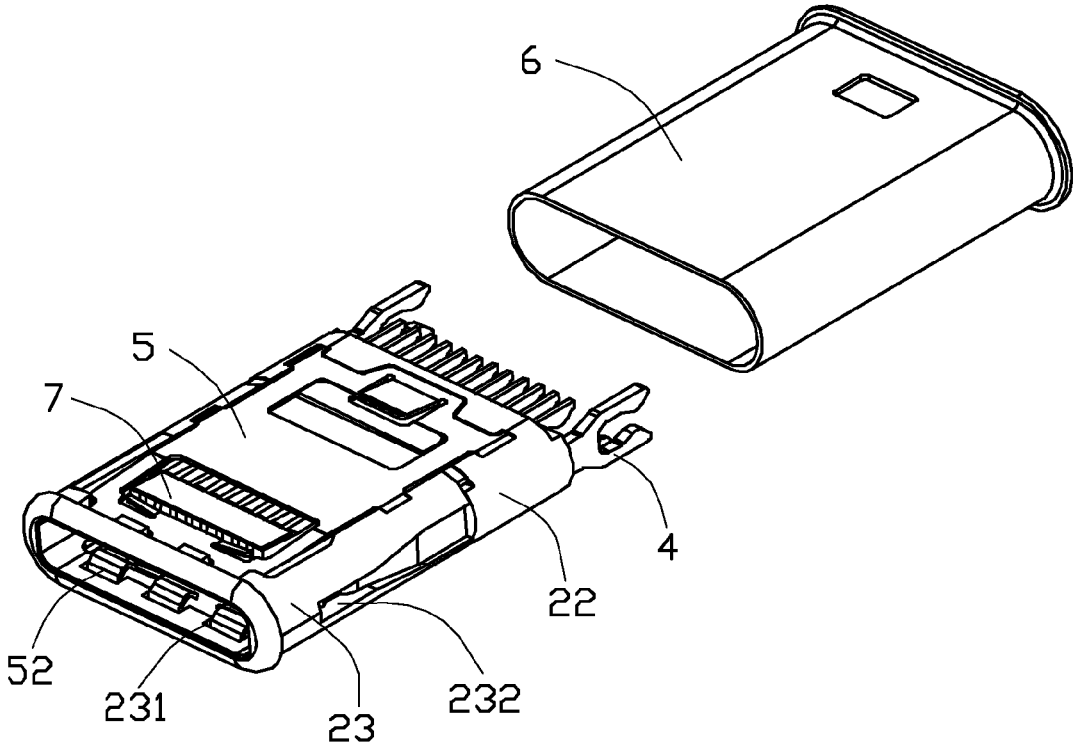
FIG. 6 is a partly assembled perspective view showing the electrical connector, with a shielding shell separated.

Referring to FIG. 5, the third housing 23 defines mating hole 231, a pair of recesses 232 at right and left sides thereof and a plurality of slits 234 at upper and lower sides thereof.

Each spring 5 has a plurality of mating portions 52 bent toward the mating hole 231 for electrically connecting with the mating receptacle. Each spring 5 has a grounding portion 53 tilting away from the mating hole 231 for contacting with the shielding shell 6. Each spring 5 is formed with a plurality of stabs 54 piercing into the second housing 22 and the third housing 23 and a tongue plate 51 tilting toward the shielding shell 6.

The shielding shell 6 is formed into a barrel and defining a pair of openings 61.

Figure 7:
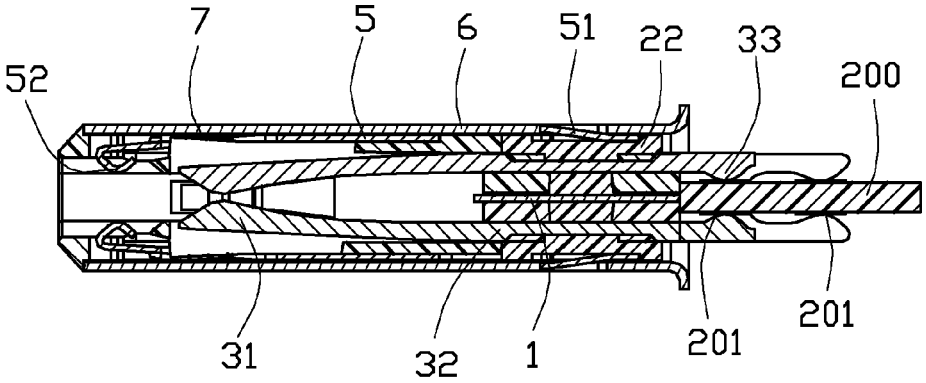
FIG. 7 is a cross-sectional view of the electrical connector and the circuit board along line 7-7 of FIG. 1.

A method of manufacturing an electrical connector 100 comprises the steps of insert molding the first housing 32 and a row of terminals 31 to form a module 3, forming a pair of the modules 3, assembling the pair of latches 4 at opposite sides of the metal plate 1, sandwiching the metal plate 1 between the pair of modules 3, and over molding a second housing 22 with the pair of modules 3, the metal plate 1 and the pair of latches 4 to form a strengthened subassembly. In the assembling step, the pair of latches 4 respectively latch with the pair of affixed portions 12 of the metal plate 1 or spot welded onto the affixed portions 12. The contacting portions of the two rows of the terminals 3 project toward each other. The contacting beams 311 of the terminals 31 extend forwardly beyond the second housing 22. Referring to FIG. 7, the metal plate 1 has a front end extending forwardly from the second housing 22 to suspend between the contacting beams 311 of the pair of modules 3 along a top-to-bottom direction. The front end of the metal plate 1 and corresponding portions of contacting beams 311 of the terminals 3 have no insulative material positioned therebetween for achieving better shielding purpose.

Then, the third housing 23 is mounted on the subassembly, with the pair of latching portions 43 of the latches 4 projecting into the mating hole 231 through the recesses 232, and the beams 311 are received within the corresponding slits 234, respectively. The pair of adhering portions 7 are adhered over the slits 234 to prevent the terminals 31 from contacting with the shielding shell 6. The pair of springs 5 are mounted on the second housing 22 and the third housing 23, with the mating portions 52 extending to the mating hole 231 for electrically connecting with the mating receptacle and the stabs 54 piercing into the second housing 22 and the third housing 23. The subassembly and the pair of springs 5 are enclosed in the shielding shell 6. The grounding portions 53 contact with the shielding shell 6. Each tongue plate 51 latches with the opening 61 of the shielding shell 6.

Referring to FIGS. 1 and 7, the electrical connector 100 are soldered on a circuit board 200 defining a plurality of conductive pads 201. The pair of soldering feet 41 of each latch 4 are used for guiding and being soldered on the conductive pads 201 of opposite sides of the circuit board 200. The soldering portions 313 of two rows of terminals 3 are used for guiding and being soldered on the conductive pads 201 of the opposite sides of the circuit board 200.

The second housing 22 is over molded with the pair of modules 3 and the metal plate 1 to firmly fix the second housing 22 and metal plate 3. The pair of latches 4 are connected with the metal plate 1 for latching with the mating receptacle and improving grounding effect. The mating portions 52 electrically connect with the mating receptacle and the grounding portions 53 contact with the shielding shell 6 for improving grounding effect.

It is to be understood, however, that even though numerous characteristics and advantages of the present invention have been set forth in the foregoing description, together with details of the structure and function of the invention, and changes may be made in detail, especially in matters of shape, size, and arrangement of parts within the principles of the invention to the full extent indicated by the broad general meaning of the terms in which the appended claims are expressed.

What is claimed is:

1. An electrical connector comprising:

a pair of modules each including a row of terminals and a first housing insert molded with the terminals, each terminal including a securing portion secured to the first housing, a soldering portion extending rearwardly from the first housing, and a contacting beam cantilevered forwardly from the first housing;

a metal plate sandwiched between the pair of modules, said metal plate having a pair of affixed portions formed at opposite sides thereof;

a pair of latches affixed to the metal plate, each latch being formed with an engaging portion; and a second housing over molded with the pair of modules, the metal plate, and of the pair of latches to form a subassembly, said second housing being over molded at the engaging portions of the latches and the affixed portions of the metal plate.

2. The electrical connector as claimed in claim 1, wherein said contacting beams of the terminals extend forwardly beyond the second housing, and the metal plate has a front end extending forwardly from the second housing to suspend between the contacting beams of the terminals of the pair of modules along an top-to-bottom direction.

3. The electrical connector as claimed in claim 1, wherein said engaging portions latch with the affixed portions.

4. The electrical connector as claimed in claim 1, wherein said engaging portions are spot welded onto the affixed portions.

5. The electrical connector as claimed in claim 1, wherein each latch has a pair of soldering feet projecting toward each other for soldering to a printed circuit board.

6. The electrical connector as claimed in claim 1, further comprising a third housing mounted on the subassembly and defining a mating hole and a pair of springs mounted on the second housing and the third housing, each spring having a plurality of mating portions bent toward the mating hole for electrically connecting with a mating receptacle.

7. electrical connector as claimed in claim 6, further comprising a shielding shell enclosing the subassembly and the pair of springs, each spring having a grounding portion extending away from the mating hole to contact the shielding shell.

8. The electrical connector as claimed in claim 6, wherein each spring is formed with a plurality of stabs piercing into the second housing and the third housing.

9. A method of manufacturing an electrical connector, comprising the steps of:

insert molding a pair of modules each having a respective first housing;

providing a pair of latches each having an engaging portion and a metal plate having a pair of affixed portions formed at opposite sides thereof, affixing a pair of latches to two opposite sides of a metal plate;

sandwiching the metal plate between the pair of modules; and over molding a second housing with the pair of modules, the affixed portions of the metal plate, and the engaging portions of the pair of latches to form a subassembly.

10. The method as claimed in claim 9, wherein the affixing step comprises latching the pair of latches to a pair of affixed portions of the metal plate.

11. The method as claimed in claim 9, wherein the affixing step comprises spot welding the pair of latches to a pair of affixed portions of the metal plate.

12. An electrical connector comprising:

an insulative main housing defining a mating hole forwardly communicating with an exterior in a front-to-back direction, and two rows of slits by two sides of the mating hole in the vertical direction perpendicular to said front-to-back direction, and a pair of recesses formed in opposite lateral sides of the housing in a transverse direction perpendicular to both said front-to-back direction and said vertical direction;

upper and lower terminal modules oppositely stacked with each other with a metallic plate therebetween in the vertical direction, each of said upper and lower terminal modules including a plurality of terminals integrally retained in an insulator via an insert molding process, each of said terminals defining a front deflectable mating portion and a rear connecting portion in the front-to-back direction;

a pair of latches associatively intimately located by two opposite lateral sides of the metallic plate, each of the latches defining a front resilient locking section and a rear connecting section in the front-to-back direction; and an insulative sub-housing integrally retaining the upper and lower terminal modules, the metallic plate and the latches together as a sub-assembly via another insert molding process; wherein in said sub-assembly, the front mating portion and the rear connecting portion of each of the terminals, and the front resilient locking section and the rear connecting section of each of the latches are exposed outside of the sub-housing.

13. The electrical connector as claimed in claim 12, wherein the insulative sub-housing is located behind the main housing, and the front deflectable mating portion of each of the terminals is received within the corresponding slit, and the front resilient locking section extends through the corresponding recess into the mating hole.

14. The electrical connector as claimed in claim 12, further including a pair of spring plates located upon opposite top and bottom surface of the main housing and attached to either the main housing or the sub-housing.

15. The electrical connector as claimed in claim 14, further including a metallic shielding sleeve surrounding the main housing and the sub-housing, and means for retaining the shielding sleeve to the spring plates for preventing relative moment therebetween along the front-to-back direction.

16. The electrical connector as claimed in claim 14, wherein a length of each of said spring plates in the front-to-back direction is essentially equal to a sum of those of the main housing and the sub-housing in the front-to-back direction.

17. The electrical connector as claimed in claim 12, wherein the sub-housing and the insulator are overlapped with each other in the front-to-back direction so as to prevent relative movement therebetween in the front-to-back direction.

18. The electrical connector as claimed in claim 12, wherein the metallic plate defines a first thickness direction along said vertical direction while each of the latches defines a second thickness direction along the transverse section, and the latches are pre-assembled to the metallic plate before the sub-housing is molded with the terminal modules.

* * * * *